US005341609A

United States Patent [19]

Gorsuch et al.

[11] Patent Number: 5,341,609

[45] Date of Patent: Aug. 30, 1994

[54] ABRASIVE BELTS AND THEIR MANUFACTURE

[75] Inventors: Jan Gorsuch; Mark R. Ennis; Robert M. Burgess, all of Kent, United Kingdom

[73] Assignee: Minnesota Mining and Manufacturing Company, St. Paul, Minn.

[21] Appl. No.: 78,484

[22] Filed: Jun. 16, 1993

Related U.S. Application Data

[63] Continuation of Ser. No. 826,811, Jan. 28, 1992, abandoned.

[51] Int. Cl.[5] ..... B24D 11/06; B24B 21/18

[52] U.S. Cl. ..... 51/399; 51/401; 51/407

[58] Field of Search ..... 51/394, 399, 401, 407, 51/293, 357, 297

[56] References Cited

U.S. PATENT DOCUMENTS

| | | | |
|---|---|---|---|
| 766,930 | 8/1904 | Clemons | 24/38 |
| 1,009,709 | 11/1911 | Furber | 51/399 |
| 1,588,255 | 6/1926 | Maxwell | 24/38 |
| 1,728,673 | 9/1929 | Driver | 51/399 |
| 2,391,731 | 12/1945 | Miller et al. | 51/188 |
| 2,445,807 | 6/1947 | Summers et al. | 51/188 |
| 2,733,181 | 1/1956 | Riedesel | 154/116 |
| 2,794,726 | 6/1957 | Riedesel et al. | 51/297 |
| 3,037,852 | 6/1962 | White | 51/293 |
| 3,154,897 | 11/1964 | Howard | 51/399 |
| 3,333,372 | 8/1967 | Gianatasio | 51/399 |
| 3,402,514 | 9/1968 | Johnson | 51/399 |
| 3,427,765 | 2/1969 | McGarvey | 51/399 |
| 3,533,876 | 10/1970 | Burgess | 156/304 |
| 3,643,387 | 2/1972 | Hildebrand | 51/399 |
| 3,729,873 | 5/1973 | Sandell | 51/399 |
| 3,763,604 | 10/1973 | Malloy | 51/399 |
| 4,018,574 | 4/1977 | Dyer | 51/399 |
| 4,027,435 | 6/1977 | Malloy | 51/399 |
| 4,194,618 | 3/1980 | Malloy | 206/205 |
| 4,215,516 | 8/1980 | Huschle et al. | 51/399 |
| 4,256,467 | 3/1981 | Gorsuch | 51/295 |
| 4,606,154 | 8/1986 | Herrmann | 51/394 |
| 5,110,668 | 5/1992 | Minnick | 428/215 |

FOREIGN PATENT DOCUMENTS

| | | | |
|---|---|---|---|
| 0134545 | 3/1985 | European Pat. Off. | F16G 3/10 |
| 0237784 | 9/1987 | European Pat. Off. | B24D 3/20 |
| 0104531 | 10/1926 | Fed. Rep. of Germany | 51/399 |
| 0508111 | 10/1926 | France | 51/399 |
| 2449743 | 9/1980 | France | D08H 5/00 |
| 0044490 | 4/1977 | Japan | 51/293 |
| 1340598 | 12/1973 | United Kingdom | C08G 22/04 |
| 1492789 | 11/1977 | United Kingdom | C09J 5/00 |
| 2232636 | 12/1990 | United Kingdom | B29C 65/40 |

*Primary Examiner*—Jack Lavinder

*Attorney, Agent, or Firm*—Gary L. Griswold; Walter N. Kirn; Gregory D. Allen

[57] ABSTRACT

This invention provides a coated abrasive belt having a backing comprising a hot-melt adhesive, and a method of making the same. The splice of the endless coated abrasive belt according to the present invention has substantially the same thickness, density, and flexibility as the remainder of the belt.

16 Claims, 1 Drawing Sheet

ABRASIVE BELTS AND THEIR MANUFACTURE

This is a continuation of application No. 07/826,811, filed Jan. 28, 1992, now abandoned.

BACKGROUND OF THE INVENTION

Field of the Invention

This invention pertains to a coated abrasive belt having a backing comprising a hot-melt adhesive therein, and a method of making the same.

Description of the Related Art

The manufacture of coated abrasive belts typically includes the joining (i.e., splicing) together of two free ends of an elongated coated abrasive strip to form an endless belt. Two types of joints are commonly used to splice the ends of the elongated strip together. The two most common types of splices used to join the ends of the elongated coated abrasive strips are known as a "lap splice" and a "butt splice."

A lap splice is formed by removing the abrasive layer from one end of the coated abrasive strip (i.e., skiving) or, in some cases, from both ends of the coated abrasive strip (i.e., double skiving), coating one or both ends of the strip with a suitable adhesive and then overlapping the ends to form a splice. The preparation of lap splices is disclosed, for example, in U.S. Pat. Nos. 1,009,709, 2,445,807, 3,037,852, and 3,643,387. The drawback of lap splices is that the joint formed is generally somewhat stiffer than the rest of the belt, a condition which predisposes the splice to failure by delamination during use of the belt. Moreover, a lap splice is usually slightly thicker than the rest of the belt which causes "bumping" or "chattering" of the belt during use, a phenomena which is particularly aggravating for the operator of the machine. Furthermore, belts having a lap splice are recommended to be run in one direction in order to minimize the chances of snagging the uppermost layer of the belt.

A "butt splice" is a joint which is formed by bringing the free ends of the belt together without overlap and securing the ends, for example, by means of a patch or strip of material (e.g., tape) over the ends of the belt opposite the abrasive layer or by incorporation of a strip of material into a portion of the backing which bridges the ends. The preparation of butt splices is disclosed, for example, in U.S. Pat. Nos. 766,930, 1,588,255, 1,728,673, 2,391,731, 2,733,181, 2,794,726, 3,154,897, 3,402,514, and 3,427,765. Although coated abrasive belts having a butt splice can be run in either direction, such belts still suffer from many of the disadvantages inherent in belts incorporating lap splices. For example, the material used to attach the ends of the coated abrasive strip frequently produces a raised area over the joint which causes premature loss of abrasive material in that region, and also causes formation of grooves in the workpiece. Moreover, such splices tend to wear out at the end portions causing them to split and pull away from each other under the stresses and strains the belt is subjected to during use. This tendency to wear out the end portions of the belt is particularly problematic when sanding or polishing hard substrates such as glass, marble, or granite. Further, a butt splice having a raised area causes the belt to "bump" or "chatter" during use of the belt on an abrading machine comprising a back support, platen, or wheel.

U.S. Pat. No. 3,333,372 discloses an abrasive belt comprising:

a flexible base sheet including an inner face and an outer face, a layer of finely divided abrasive particles adhesively secured to the outer surface, the flexible base sheet having end portions abutting each other to form a closed, continuous loop, a film of flexible adhesive material on the inner surface of the flexible base sheet, a reinforcing film of a tough, flexible reinforcing material bonded to the adhesive film on the inner surface of the latter, the flexible reinforcing film comprising a material selected from the group of film-forming materials consisting of poly(ethylene terephthalate) and vulcanized fiber, the flexible sheet base having a joint with abutting end portions cut at an angle of about 45° relative to the side edges of the flexible base sheet, and the reinforcing film having a fused joint spaced longitudinally from the first joint and with abutting end portions cut at acute angles relative to the side edges thereof.

SUMMARY OF THE INVENTION

The present invention provides a coated abrasive belt comprising an abrasive layer attached to a flexible backing material which comprises at least one flexible support and a hot-melt adhesive layer, and is in the shape of an elongated strip having abutted complementary ends with the hot-melt adhesive layer being continuous over the abutted ends to provide a splice, the coated abrasive belt being of substantially the same thickness throughout its length. The width of the coated abrasive article has a width that is equal to the width of the elongated strip. Preferably, the flexible backing material comprises two flexible supports, the hot-melt adhesive being interposed between the two flexible supports. Preferably, the coated abrasive belt is endless.

In another aspect, the present invention provides a simple and effective method of preparing a coated abrasive belt, the method comprising the steps of:

Method I (a) providing an elongated strip of a flexible backing material having complementary ends, at least one major surface, and having an abrasive layer attached to the major surface, the flexible backing material comprising at least one flexible support and a hot-melt adhesive layer;

(b) abutting the complementary ends to provide a belt;

(c) applying pressure and heat over an area of the abutting ends sufficient to cause the hot-melt adhesive to flow across the abutting complementary ends; and (d) allowing said heated area to cool, whereby the hot-melt adhesive is continuous over the abutting complementary ends and provides a splice; or Method II (a) providing an elongated strip of a flexible backing material having complementary ends and having at least one major surface, the flexible backing material comprising at least one flexible support and a hot-melt adhesive layer;

(b) abutting the complementary ends to provide a belt;

(c) applying pressure and heat over an area of the abutting ends sufficient to cause said hot-melt adhesive to flow across the abutting complementary ends; and (d) allowing the heated area to cool, whereby the hot-melt adhesive is continuous over the abutting complementary ends and provides a splice; and (e) applying an abrasive layer to the major surface. Step (e) of method II can be performed at any convenient time prior to, during, or after steps (a)-(d).

The coated abrasive belt may be in any conventional form including those having an abrasive layer comprising a make layer, abrasive granules or particles, a size layer, etc., and other functional layers (e.g., a supersize layer), and those having a monolayer as an abrasive layer comprising a slurry layer comprising a bond system and abrasive grain, and other functional layers. Preferably, the abrasive layer comprises a mesh material onto which is electroplated a layer of a metal, into which are embedded abrasive granules or particles.

Coated abrasive belts according to the present invention have a substantially uniform thickness, without the use of reinforcing patches or the like. The splice in the coated abrasive belt has sufficient strength to maintain the integrity of the belt during use. Coated abrasive belts according to the present invention can be run in either direction. Further, such belts tend to provide a greater useful life compared to coated abrasive belts having conventional splices (e.g., butt splices, lap splices, etc.). Moreover, as the joint of a coated abrasive belt according to the present invention has substantially the same thickness, density, and flexibility as the remainder of the belt, the belt is less prone to premature wear in the joint regions, thereby avoiding the problems of work piece marking, and "bump" or "chatter."

DETAILED DESCRIPTION OF THE PREFERRED EMBODIMENTS

The coated abrasive belt of the present invention may take any of a variety of embodiments, as will be explained below.

Figure 1:
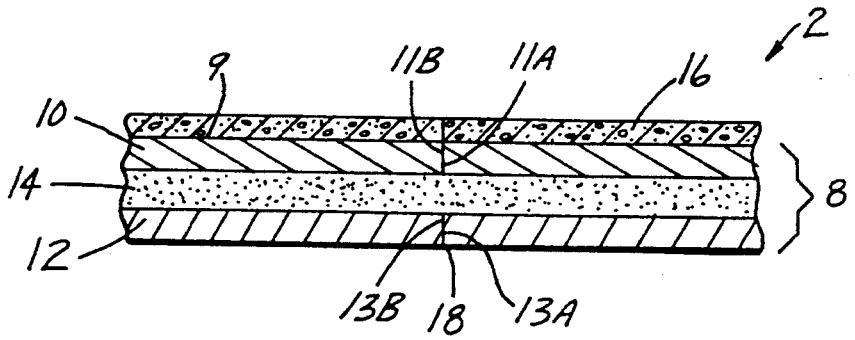
FIG. 1 is an enlarged cross-sectional view of a splice portion of a coated abrasive belt made in accordance to the present invention.

Referring to FIG. 1, coated abrasive belt 2 comprises flexible elongated backing material 8 and has major surface 9 and abrasive layer 16 attached to major surface 9. Flexible elongated backing material 8 comprises flexible supports 10 and 12 having ends 11A and 11B, and 13A and 13B, respectively, and has sandwiched between flexible supports 10 and 12 layer of hot-melt adhesive 14.

An alternative embodiment (not shown) comprises a flexible backing material comprising a flexible support, an abrasive layer, and a hot-melt adhesive layer sandwiched therebetween.

Figure 2:
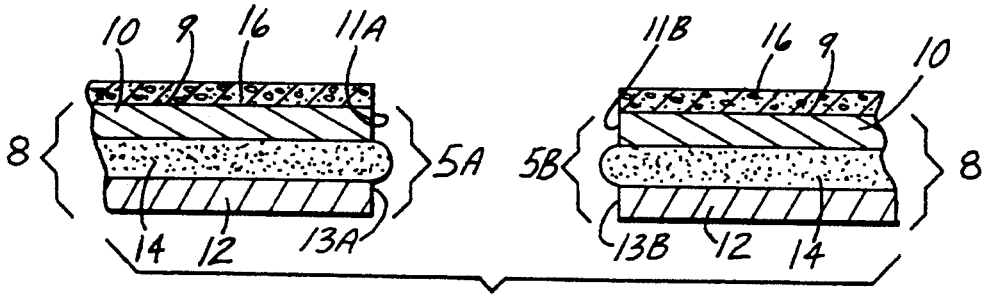
FIG. 2 is an enlarged cross-sectional view of a coated abrasive back material prior to splicing.

FIG. 2 illustrates flexible elongated backing material 8 prior to splicing ends 5A and 5B. Abrasive layer 16 can be applied to major surface 9 of flexible elongated backing material 8 before or after splicing ends 5A and 5B.

The flexible support of the backing material may comprise any suitable material known in the art including, for example, woven and non-woven webs, papers, fabrics, cloths, and polymeric films. Preferably, the flexible support comprises a web of a woven material.

The hot-melt adhesive is selected so that the melting temperature of the adhesive is above the operating temperature of the abrasive belt. For high temperature applications the melting point of the hot-melt adhesive should be at least 200° C., while for lower temperature applications, the melting point may be as low as 120° C. Preferably, the hot-melt adhesive is a polyester-based adhesive.

Preferably, the backing material comprises two flexible supports sandwiching a layer of hot-melt adhesive therebetween. Typically the backing material has a thickness in the range from about 0.5 to about 2.5 mm. Preferably the thickness of the backing material is in the range from about 1.0 to about 1.5 mm, and most preferably it is about 1.3 mm. The weight of the backing material is typically in the range from about 0.5 to about 2.5 $kg/m^2$. Preferably the weight of the backing material is in the range from about 0.75 to 1.5 $kg/m^2$, and most preferably it is about 1.15 $kg/m^2$.

Suitable backing materials are commercially available and include, for example, a backing comprising two woven polyester cotton sheets with a layer of a polyester hot-melt adhesive therebetween available under the trade designation "BETALON TC13/NM" from Charles Walker & Co., Ltd. of Bingley, West Yorkshire, UK.

The backing may further comprise at least one of a presize (i.e., a barrier coat overlying the major surface of the backing onto which the abrasive layer is applied), a backsize (i.e., a barrier coat overlying the major surface of the backing opposite the major surface onto which the abrasive layer is applied), and a saturant (i.e., a barrier coat that is coated on all exposed surfaces of the backing). Preferably, the backing material comprises a presize. Suitable presize, backsize, or saturant materials are known in the art. Such materials include, for example, resin or polymer lattices, neoprene rubber, butylacrylate, styrol, starch, hide glue, and combinations thereof.

A preferred method of splicing the coated abrasive belt according to the present invention includes bringing the two complementary ends of the elongated backing material into abutting engagement, securing them in position, heating the two ends to a temperature sufficient to melt the hot-melt adhesive in the region immediately adjacent to the line of abutment, providing sufficient pressure to cause the melted adhesive to flow across the joint, and cooling the heated regions while continuing to maintain the pressure applied thereto, such that the adhesive forms a continuous film or layer across the splice.

Figure 3:
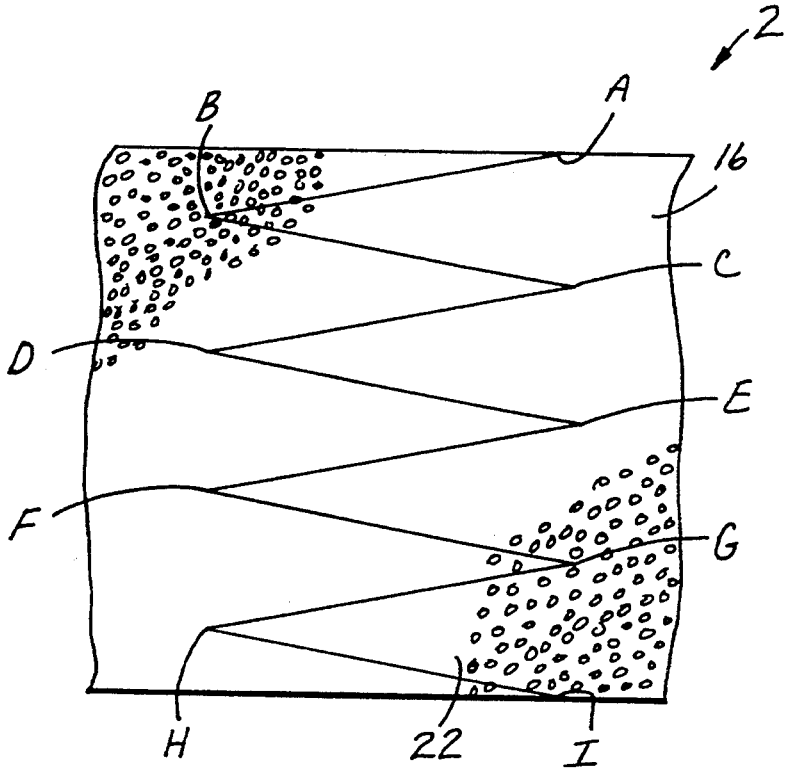
FIG. 3 is a plan view of a splice of a coated abrasive belt made in accordance to the present invention.

The complementary ends of the backing material are preferably cut in a manner such that the length of the abutting edges is greater than the width of the belt. This may be achieved by simply cutting the ends at an angle to the longitudinal axis of the elongate strip of material, or more preferably by having ends with a plurality of complementary and interengaging tapered fingers (e.g., as shown by sawtooth pattern 22 illustrated in FIG. 3 or by the interlocking projections or tongues disclosed in U.S. Pat. Nos. 766,930 and 1,588,255, the disclosures of which are incorporated herein by reference). Preferably each complementary end has an abutting length that is at least three times the width of the elongate strip, wherein an abutting length is the total exposed length of each abutting end (e.g., the abutting length of each complementary end of sawtooth pattern 22 is defined by ABCDEFGHI). More preferably, the abutting length is at least five times the width of the elongate strip.

With the exception of the backing material and the method of splicing the same, a coated abrasive belt according to the present invention can be prepared using materials and techniques known in the art for constructing coated abrasive articles.

The preferred bond system (i.e., slurry coat or make coat and size coat) is a resinous or glutinous adhesive. Examples of typical resinous adhesives include phenolic resins, urea-formaldehyde resins, melamine-formaldehyde resin, epoxy resins, acrylate resins, urethane resins, and combinations thereof. The bond system may contain other additives which are well known in the art, such as, for example, grinding aids, plasticizers, fillers, coupling agents, wetting agents, dyes, and pigments.

Preferably, the abrasive grains are selected from such known grains as fused aluminum oxide, heat-treated aluminum oxide, ceramic aluminum oxide, co-fused alumina-zirconia, garnet, silicon carbide, diamond, cubic boron nitride, and combinations thereof.

Examples of useful materials which may be used in the supersize coat include the metal salts of fatty acids, urea-formaldehyde, novalak phenolic resins, waxes, mineral oils, and fluorochemicals. The preferred supersize is a metal salt of a fatty acid such as, for example, zinc stearate.

In the first preferred conventional method for preparing a coated abrasive article, a make coat is applied to a major surface of the backing following by projecting a plurality of abrasive granules into the make coat. It is preferable in preparing the coated abrasive that the abrasive granules be electrostatically coated. The make coating is cured in a manner sufficient to at least partially solidify it such that a size coat can be applied over the abrasive granules. Next, the size coat is applied over the abrasive granules and the make coat. Finally, the make and size coats are fully cured. Optionally, a supersize coat can be applied over the size coat and cured.

In the second preferred conventional method for preparing a coated abrasive article, a slurry containing abrasive granules dispersed in a bond material is applied to a major surface of the backing. The bond material is then cured. Optionally, a supersize coat can be applied over the slurry coat and cured.

In the above methods, the make coat and size coat or slurry coat can be solidified or cured by means known in the art, including, for example, heat or radiation energy.

For an abrasive layer comprising a layer of a mesh material onto which is electrodeposited a layer of metal (e.g., nickel), into which are embedded abrasive granules, the coated mesh material is typically laminated onto a major surface of the backing material or alternatively, in the case of a single layer backing onto the adhesive layer.

The preparation of suitable electrodeposited abrasive layers is known in the art and disclosed, for example, in U.S. Pat. No. 4,256,467, the disclosure of which is incorporated herein by reference for its teaching of a coated abrasive belt having an abrasive layer comprising a mesh with abrasive grain attached thereto. Generally, the abrasive layer is formed by laying a length of mesh material onto an electrically conducting surface and electrodepositing a metal onto the mesh material in the presence of abrasive granules such that the abrasive granules become embedded in the metal. If a pattern of abrasive granules is desired, an insulating material is selectively applied to the mesh material before deposition of the metal layer so that the metal can only deposit onto the mesh in those areas not covered by the insulating material, thereby defining the pattern of the abrading surface.

In one method of making an electrodeposited abrasive layer, a mesh material in the form of a woven fabric of electrically insulating material such as nylon, cotton or terylene is screen printed with an ink comprising an insulating material, wherein the ink is compatible with any hot-melt adhesive which may subsequently be applied to the abrasive layer to secure it to the backing material. Preferably, the ink is resin-based or oil-based ink. The ink may be colored as desired. Typically, the insulating material is waterproof and acid resistant. Preferably, the insulating material is color fast at elevated working temperatures of the abrasive article, (e.g., up to about 220° C.).

Conventional screen printing techniques may be used to print the ink onto the mesh. If a pattern of abrasive granules is desired, the screen printing technique used must ensure that the ink penetrates into and is absorbed onto defined areas of the mesh material such that discrete areas with and without ink are provided. Such discrete areas may be of any convenient shape and size, including, for example, circles, diamonds, squares, rectangles, etc.

The abrasive layer comprising the mesh material can be adhered to the backing material by applying a layer of adhesive to either the abrasive layer or the backing material. The adhesive material is then cured, or in the case of a hot-melt adhesive, heated and then cooled. Preferably, the adhesive is acid resistant and water repellent. Suitable adhesives include, for example, that marketed under the trade designation "BOSTICK 3206" from Bostick Ltd. of Leicester, UK.

In another method, the ink may be combined with an adhesive and screen printed onto the mesh material. The metal and abrasive is deposited, as described above, and the resulting abrasive layer may be applied to the backing material and the adhesive material cured, or in the case of a hot-melt adhesive, heated and then cooled. Preferably, the adhesive is acid resistant and water repellant.

In another method, instead of the insulating material being an ink or an ink and an adhesive, a hot-melt adhesive only is used as the insulating material. Preferably, the hot-melt adhesive is acid resistant and water repellent. The hot-melt adhesive may be, for example, a sheet which is applied to the mesh material before electrodeposition. Typically, the adhesive sheet has a plurality of openings of desired shape and size. The hot-melt adhesive sheet is placed in contact with the mesh material and heated while applying sufficient pressure to cause the adhesive to absorb and enter the spaces of the mesh material. When the mesh material is fully penetrated the resulting composite is cooled. The mesh material is then electrodeposited with metal and abrasive as described above. The resulting abrasive layer has adhesive on both sides of the mesh material, and surrounding the metal areas. The abrasive layer can be readily adhered to the backing material by applying sufficient heat through the surface of the backing material opposite that onto which the abrasive layer is to be attached to cause the adhesive to adhere the mesh material to the backing material.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An endless coated abrasive belt comprising a flexible backing laminate material having a major surface and an abrasive layer attached to said major surface, said flexible backing laminate material comprising two flexible support layers and a hot-melt adhesive layer interposed between said two flexible support layers, said hot-melt adhesive layer being parallel to said major surface of said flexible backing laminate material, said flexible support layers each having a first and a second complementary end, said flexible backing laminate material being in the shape of an elongated strip having a length, a width, and said complementary ends abutted, said hot-melt adhesive layer extending the length of said belt and being continuous over said abutted ends to provide a splice, each of said first complementary ends of each of said flexible support layers being substantially coterminous with each other and said second complementary ends of said flexible support layers being substantially coterminous with each other, said coated abrasive belt being of substantially the same thickness throughout its length, and said coated abrasive belt having a width equal to said width of said elongated strip.

2. The coated abrasive belt according to claim 1 wherein said at least one of flexible support layers is a woven web.

3. The coated abrasive belt according to claim 1 wherein said hot-melt adhesive layer comprises a hot-melt adhesive having a melting point of at least 120° C.

4. The coated abrasive belt according to claim 1 wherein each of said first and second complementary ends have an abutting length that is at least three times the width of said elongated strip.

5. The coated abrasive belt according to claim 1 wherein each of said complementary ends has a plurality of tapered fingers.

6. The coated abrasive belt according to claim 1 wherein said first and second complementary ends of each respective layer are interlocking.

7. The coated abrasive belt according to claim 1 wherein said abrasive layer and said complementary ends are coterminous.

8. The coated abrasive belt according to claim 1 wherein said abrasive layer comprises a mesh having abrasive grain attached thereto.

9. The coated abrasive belt according to claim 8 wherein said mesh is electrically insulating.

10. The coated abrasive belt according to claim 8 wherein said abrasive grain attached to said mesh is arranged in a pattern.

11. The coated abrasive belt according to claim 1 wherein said abrasive layer comprises a mesh material having a layer of metal electrodeposited thereon and abrasive granules embedded in said layer of metal.

12. An endless coated abrasive belt comprising a flexible backing laminate material having a major surface and an abrasive layer attached to said major surface, said flexible backing laminate material comprising two flexible support layers and a hot-melt adhesive layer interposed between said two flexible supports, said hot-melt adhesive layer being parallel to said major surface of said flexible backing laminate material, said flexible support layers each having a first and a second complementary end, said flexible backing laminate material being in the shape of an elongated strip having a length, a width, and said complementary ends abutted, said hot-melt adhesive layer extending the length of said belt and being continuous over said abutted ends to provide a splice, each of said first complementary ends of each of said flexible support layers being substantially coterminous with each other and said second complementary ends of said flexible support layers being substantially coterminous with each other, said coated abrasive belt being of substantially the same thickness throughout its length, said coated abrasive belt having a width equal to said width of said elongated strip, said hot-melt adhesive layer comprising a hot-melt adhesive having a melting point of at least 120° C., an each of said first and second complementary ends having an abutting length that is at least three times the width of said elongated strip.

13. The coated abrasive belt according to claim 12 wherein each of said complementary ends have a plurality of tapered fingers.

14. The coated abrasive belt according to claim 12 wherein said abrasive layer and said complementary ends are coterminous.

15. An endless coated abrasive belt comprising a flexible backing laminate material having a major surface and an abrasive layer attached to said major surface, said flexible backing laminate material comprising two flexible support layers and a hot-melt adhesive layer interposed between said two flexible supports, said hot-melt adhesive layer being parallel to said major surface of said flexible backing laminate material, said flexible support layers each having a first and a second complementary end, said flexible backing laminate material being in the shape of an elongated strip having a length, a width, and said complementary ends abutted, said hot-melt adhesive layer extending the length of said belt and being continuous over said abutted ends to provide a splice, each of said first complementary ends of each of said flexible support layers being substantially coterminous with each other and said second complementary ends of said flexible support layers being substantially coterminous with each other, said coated abrasive belt being of substantially the same thickness throughout its length, said coated abrasive belt having a width equal to said width of said elongated strip, said hot-melt adhesive layer comprising a hot-melt adhesive having a melting point of at least 120° C., said abrasive layer comprising an electrically insulating mesh material having a layer of metal electrodeposited thereon and abrasive granules embedded in said layer of metal, and each of said first and second complementary ends having an abutting length that is at least three times the width of said elongated strip.

16. The coated abrasive belt according to claim 15 wherein said abrasive grain attached to said mesh is arranged in a pattern.

* * * * *

UNITED STATES PATENT AND TRADEMARK OFFICE

CERTIFICATE OF CORRECTION

PATENT NO.: 5,341,609

DATED: August 30, 1994

INVENTOR(S): Gorsuch et al.

It is certified that error appears in the above-identified patent and that said Letters Patent is hereby corrected as shown below:

On the title page:

Item [75], "Jan Gorsuch" should be --Ian Gorsuch--.

Col. 8, line 21, "an each" should be --and each--.

Signed and Sealed this

Thirteenth Day of June, 1995

*Attest:*

BRUCE LEHMAN

*Attesting Officer*

*Commissioner of Patents and Trademarks*